US011840830B2

(12) United States Patent
Sullivan

(10) Patent No.: US 11,840,830 B2
(45) Date of Patent: Dec. 12, 2023

(54) SINK DISPOSER SPLASH GUARD

(71) Applicant: Seamless Drain, LLC, Cincinnati, OH (US)

(72) Inventor: Daniel O. Sullivan, Dayton, KY (US)

(73) Assignee: Seamless Drain, LLC, Cincinnati, OH (US)

( * ) Notice: Subject to any disclaimer, the term of this patent is extended or adjusted under 35 U.S.C. 154(b) by 0 days.

(21) Appl. No.: 17/217,646

(22) Filed: Mar. 30, 2021

(65) Prior Publication Data

US 2021/0214927 A1 Jul. 15, 2021

Related U.S. Application Data

(63) Continuation-in-part of application No. 16/383,588, filed on Apr. 13, 2019, now abandoned.

(60) Provisional application No. 62/657,445, filed on Apr. 13, 2018.

(51) Int. Cl.
*E03C 1/181* (2019.01)
*E03C 1/266* (2006.01)

(52) U.S. Cl.
CPC ..... *E03C 1/181* (2013.01); *E03C 1/2665* (2013.01)

(58) Field of Classification Search
CPC ..... E03C 1/2665
USPC ..... 241/46.012–46.16; 4/658, 286–295
See application file for complete search history.

(56) References Cited

U.S. PATENT DOCUMENTS 2,536,930 A * 1/1951 Hammell ..... E03C 1/2665 241/46.016
2,667,308 A * 1/1954 Hammes ..... E03C 1/2665 241/46.016
2,737,191 A * 3/1956 Viall ..... E03C 1/2665 241/46.016
2,795,330 A * 6/1957 Sawyer ..... F16P 1/02 241/46.016
2005/0276039 A1* 12/2005 Hillenbrand ..... E03C 1/30 362/120
2018/0171611 A1* 6/2018 Ratledge ..... E03C 1/22

* cited by examiner

*Primary Examiner* — Christine J Skubinna
(74) *Attorney, Agent, or Firm* — Dorton & Willis LLP; Ryan Willis

(57) ABSTRACT

A splash guard is adapted to be removably mounted in a neck portion of a sink disposer. The splash guard basically comprises a generally cylindrical sleeve which is sized to slidably fit into the neck portion of the disposer and defines a central bore; an upper ledge partially obstructing an upper portion of the central bore; a central ledge partially obstructing a medial portion of the central bore in opposition to the upper ledge; and a chute extending downwardly from a portion of the sleeve opposite the central ledge and terminating below said central ledge.

14 Claims, 3 Drawing Sheets

SINK DISPOSER SPLASH GUARD

RELATED APPLICATION

The present application is a continuation-in-part of U.S. patent application Ser. No. 16/383,588 filed Apr. 13, 2019, now abandoned, and claims the priority filing date of U.S. Provisional Patent Application No. 62/657,445 filed Apr. 13, 2018.

BACKGROUND OF THE INVENTION

The present invention relates to sinks equipped with food disposers and more particularly to protective devices therefor.

The present inventor was struck by a number of drawbacks to conventional sink disposers. First, dining utensils could fall into the grinding chamber. Also, they were not equipped to prevent a young child from inserting a hand into the disposer.

SUMMARY OF THE INVENTION

A splash guard is adapted to be removably mounted in a neck portion of a sink disposer. The splash guard basically comprises a generally cylindrical sleeve sized to slidably fit into the neck portion of the disposer and defining a central bore, an upper ledge affixed to a portion of the sleeve and partially obstructing the central bore, a central ledge opposite the upper ledge affixed to a portion of the sleeve and partially obstructing the central bore, and a chute extending from a portion of the sleeve opposite the central ledge and terminating below the ledge.

DETAILED DESCRIPTION OF EXEMPLARY EMBODIMENT

Figure 1:
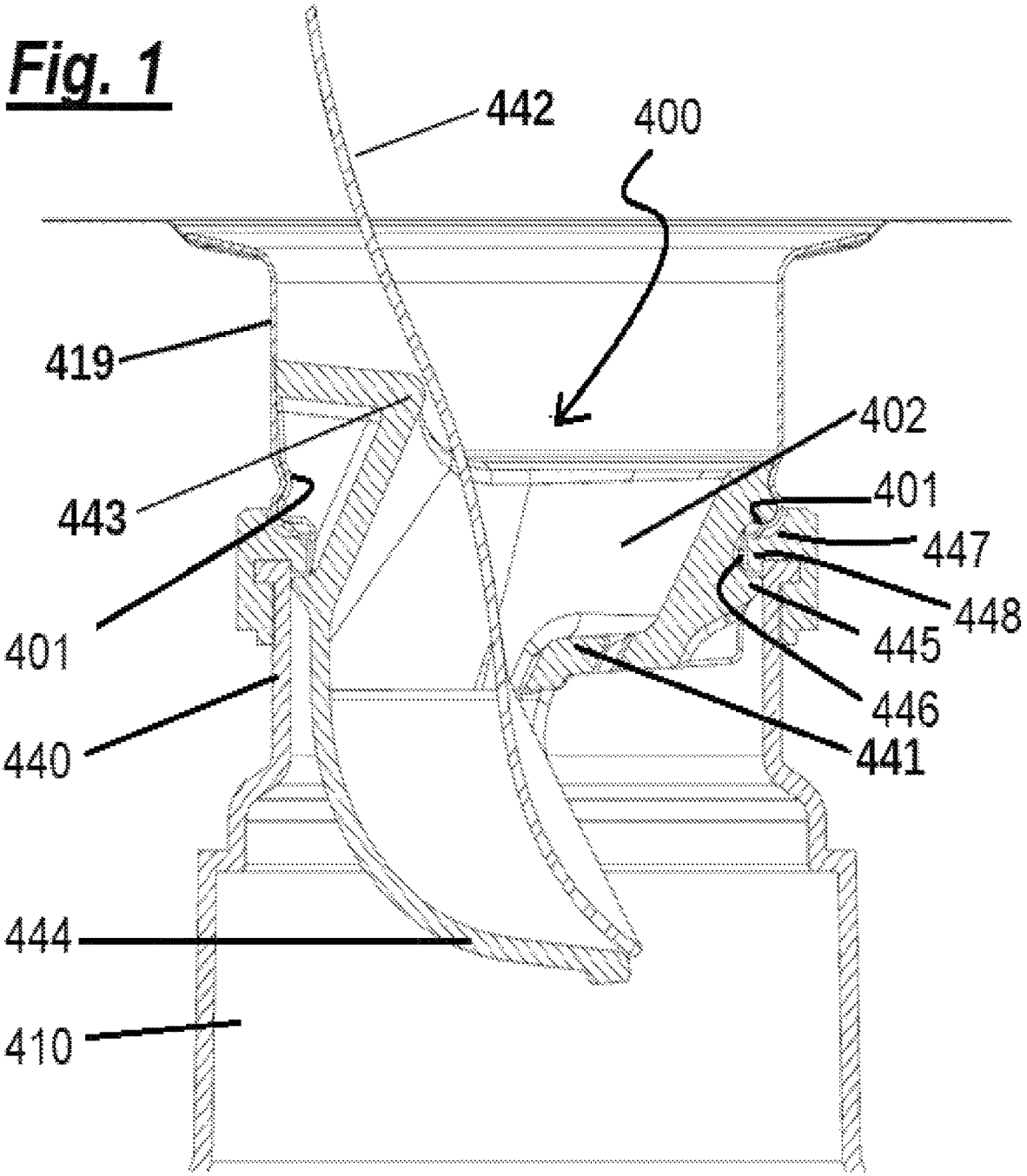
FIG. 1 is a sectional view of a fourth embodiment of the splash guard.
Figure 2:
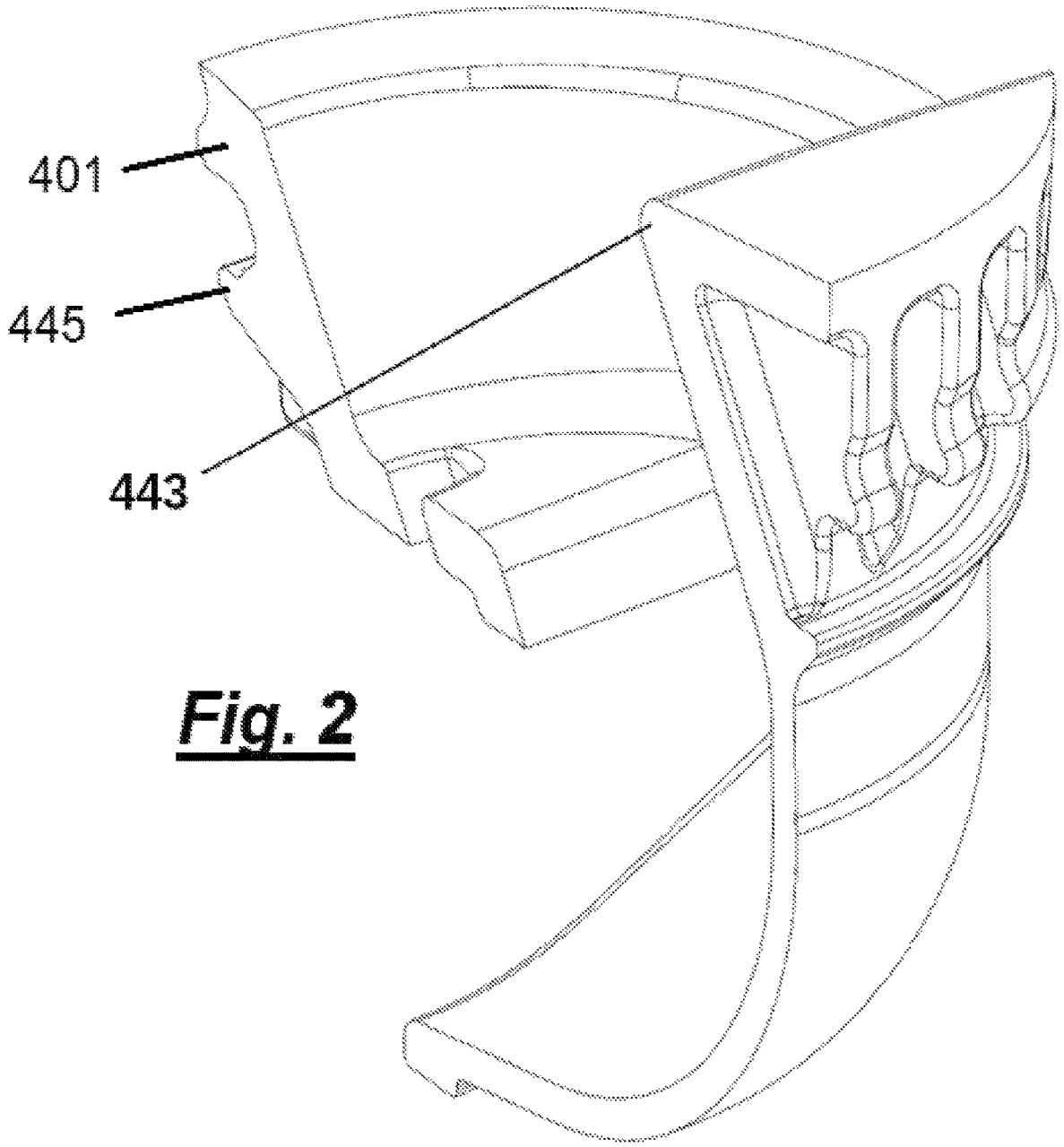
FIG. 2 is a fragmentary perspective view of splash guard of FIG. 1.
Figure 3:
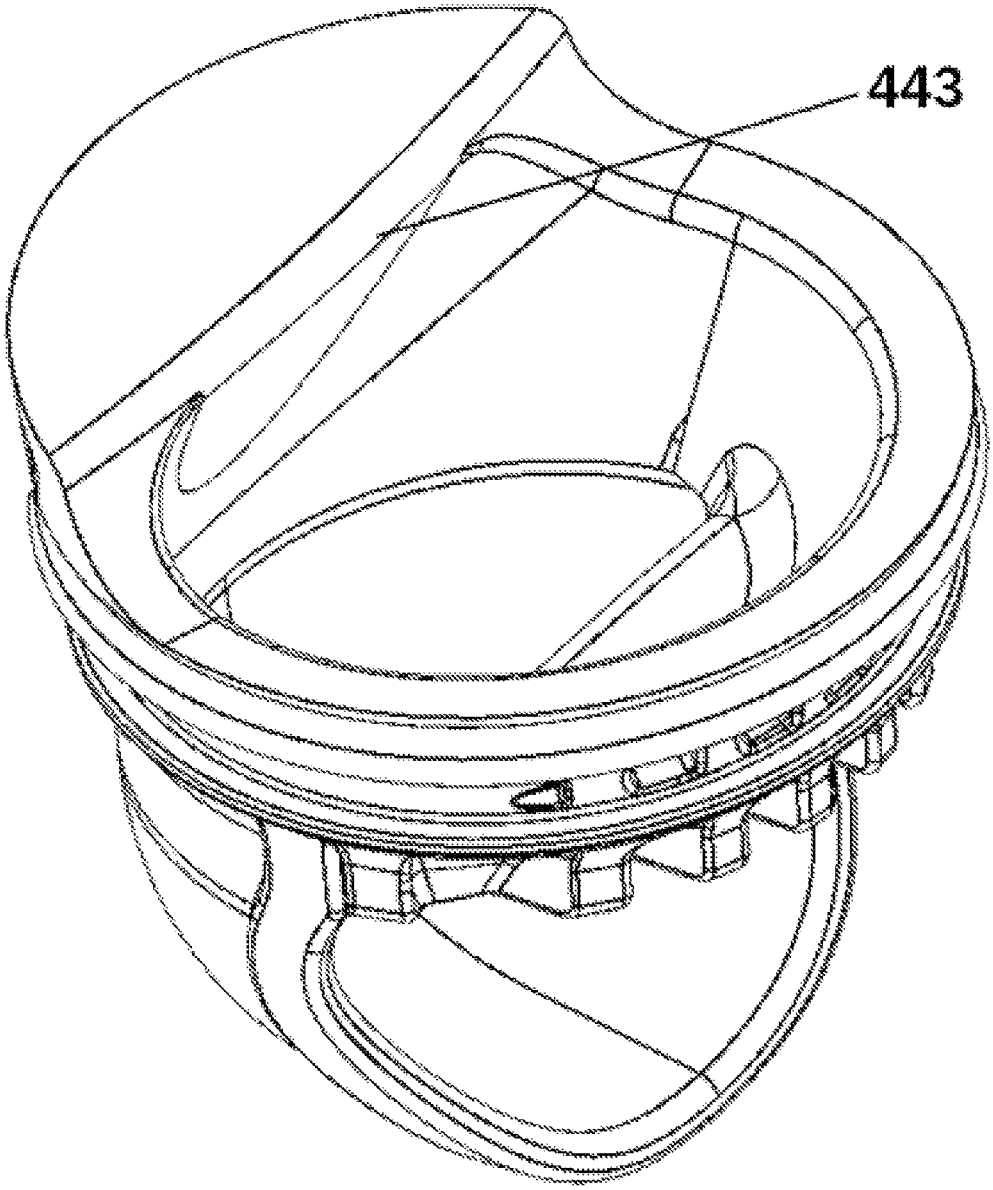
FIG. 3 is an upper perspective view of the splash guard of FIG. 1.

As illustrated in FIGS. 1-3, a splash guard generally designated 400 is adapted to be removably mounted in a neck portion 419 of a sink disposer 410. The splash guard basically comprises: a generally cylindrical sleeve 401 which is sized to slidably fit into the neck 419 of the disposer and defines a central bore 402; an upper ledge 443 partially obstructing an upper portion of the central bore 402; a central ledge 441 partially obstructing a medial portion of the central bore in opposition to the upper ledge; and a chute 444 extending downwardly from a portion of the sleeve opposite the central ledge 441 and terminating below said central ledge. The splash guard is designed to prevent debris and water from splashing out of the neck of the disposer and to prevent utensils 442 from entering the disposer's grinding chamber. The utensils are blocked from doing so by the geometry of the upper ledge 443, the opposite, centrally located ledge 441 and by the end of the chute 444. The geometry of the splash guard 400 also prevents a child's hand from entering the grinding chamber. Removal of the child-safe splash guard is made difficult for a child by the circumferential wedge shaped protrusion 445 on the exterior of the cylindrical sleeve 401. The protrusion 445 slips under an inwardly facing lip 446 created by the lower end of the disposer mounting flange 447 and the inward facing rubber lip of the disposer mounting seal 448. The splash guard may be of any design that facilitates a sturdy fit and is preferably molded from an elastomeric material such as rubber or silicone.

The invention claimed is:

1. A sink drain splash guard comprising:

a sleeve delineating a vertical, non-linear flow path and configured to wedge at least partially within a mounting flange of a sink garbage disposal, the outer periphery of the sleeve demarcating a first peripheral groove, the sleeve including, a vertically recessed ledge radially protruding from an interior circumference of the sleeve to reduce a horizontal cross-sectional area of the flow path; and a chute having an interior surface that slopes downward to direct contents along the flow path, at least a portion of the chute underlapping at least a portion of the vertically recessed ledge.

2. The sink drain splash guard of claim 1, wherein:

the flow path has a maximum horizontal cross-sectional area along the chute;

the flow path has a minimum horizontal cross-sectional area proximate the vertically recessed ledge.

3. The sink drain splash guard of claim 1, wherein:

a vertical cross-section of the sink drain splash guard includes opposed interior surfaces, above the vertically recessed ledge, both slanted in a first direction;

the vertical cross-section of the sink drain splash guard includes an interior surface of the chute that tapers in a second direction, opposite the first direction.

4. The sink drain splash guard of claim 1, further comprising:

an upper ledge extending radially from the interior circumference of the sleeve, the upper ledge positioned generally above and opposite circumferentially from the vertically recessed ledge.

5. The sink drain splash guard of claim 1, wherein the outer periphery of the sleeve demarcates a second peripheral groove, positioned above the first peripheral groove, configured to receive a radially protruding lip of the mounting flange.

6. The sink drain splash guard of claim 1, wherein:

the sleeve includes a first projection extending radially outward from an exterior surface of the sleeve;

the sleeve includes a second projection extending radially outward from the exterior surface of the sleeve, the second projection located above the first projection;

the first peripheral groove vertically interposes the first projection and the second projection.

7. The sink drain splash guard of claim 1, wherein the mounting flange including a radially protruding lip that, upon wedging of the sink drain splash guard, is received within the first peripheral groove.

8. A garbage disposal assembly comprising:

a sink garbage disposal housing;

a sink mounting flange configured to be received within a sink drain opening;

a garbage disposal mounting flange configured to mount the garbage disposal housing to the sink mounting flange; and, a sink drain splash guard including a sleeve delineating a vertical, non-linear flow path and configured to wedge at least partially within at least one of the sink mounting flange and the garbage disposal mounting flange, the outer periphery of the sleeve demarcating a first peripheral groove, the sleeve including, a vertically recessed ledge radially protruding from an interior circumference of the sleeve to reduce a horizontal cross-sectional area of the flow path; and a chute having an interior surface that slopes downward to direct contents along the flow path, at least a portion of the chute underlapping at least a portion of the vertically recessed ledge.

9. The sink drain splash guard of claim 8, wherein:

the flow path has a maximum horizontal cross-sectional area along the chute;

the flow path has a minimum horizontal cross-sectional area proximate the vertically recessed ledge.

10. The sink drain splash guard of claim 8, wherein:

a vertical cross-section of the sink drain splash guard includes opposed interior surfaces, above the vertically recessed ledge, both slanted in a first direction;

the vertical cross-section of the sink drain splash guard includes an interior surface of the chute that tapers in a second direction, opposite the first direction.

11. The sink drain splash guard of claim 8, further comprising:

an upper ledge extending radially from the interior circumference of the sleeve, the upper ledge positioned generally above and opposite circumferentially from the vertically recessed ledge.

12. The sink drain splash guard of claim 8, wherein the outer periphery of the sleeve demarcates a second peripheral groove, positioned above the first peripheral groove, configured to receive a radially protruding lip of the garbage disposal mounting flange.

13. The sink drain splash guard of claim 8, wherein:

the sleeve includes a first projection extending radially outward from an exterior surface of the sleeve;

the sleeve includes a second projection extending radially outward from the exterior surface of the sleeve, the second projection located above the first projection;

the first peripheral groove vertically interposes the first projection and the second projection.

14. The sink drain splash guard of claim 8, wherein the sink mounting flange including a radially protruding lip that, upon wedging of the sink drain splash guard, is received within the first peripheral groove.

* * * * *